US008739747B2

(12) United States Patent
Kim

(10) Patent No.: US 8,739,747 B2
(45) Date of Patent: Jun. 3, 2014

(54) PISTON COOLING APPARATUS

(75) Inventor: Won Nyun Kim, Seoul (KR)

(73) Assignee: Doosan Infracore Co., Ltd., Incheon (KR)

( * ) Notice: Subject to any disclaimer, the term of this patent is extended or adjusted under 35 U.S.C. 154(b) by 260 days.

(21) Appl. No.: 13/125,501

(22) PCT Filed: Oct. 21, 2009

(86) PCT No.: PCT/KR2009/006070
§ 371 (c)(1),
(2), (4) Date: Apr. 21, 2011

(87) PCT Pub. No.: WO2010/047518
PCT Pub. Date: Apr. 29, 2010

(65) Prior Publication Data

US 2011/0192359 A1 Aug. 11, 2011

(30) Foreign Application Priority Data

Oct. 22, 2008 (KR) ..... 10-2008-0103765

(51) Int. Cl.
*F01P 1/04* (2006.01)

(52) U.S. Cl.
USPC ..... 123/41.35; 92/186

(58) Field of Classification Search
USPC ..... 123/41.35
See application file for complete search history.

(56) References Cited

U.S. PATENT DOCUMENTS 7,281,466 B1 10/2007 Wilksch et al.

FOREIGN PATENT DOCUMENTS

| | | | | |
|---|---|---|---|---|
| DE | 3707462 | A | * | 9/1988 |
| DE | 10126359 | | | 1/2003 |
| DE | 10126359 | A1 | * | 1/2003 |
| JP | 2588924 | | | 3/1997 |
| KR | 1020040035351 | A1 | | 4/2004 |
| KR | 1020080080546 | A | | 9/2008 |
| WO | 2006027157 | A1 | | 3/2006 |

OTHER PUBLICATIONS

Search Report dated May 31, 2010 for International application No. PCT/KR2009/006070, filed Oct. 21, 2009.
Office Action dated Jul. 1, 2013 issued in Chinese Patent Application No. 200980142030.3, 6 pages.

* cited by examiner

*Primary Examiner* — Noah Kamen
(74) *Attorney, Agent, or Firm* — John D. Veldhuis-Kroeze; Westman, Champlin & Koehler, P.A.

(57) ABSTRACT

The present invention relates to a piston cooling device for cooling a piston. The piston cooling device according to an exemplary embodiment of the present invention includes: a cooling channel that is formed in a piston such that cooling fluid flows, and communicates with an intake port through which cooling fluid flows inside from the outside at a point and with an exhaust port through which the cooling fluid is discharged outside at another point; and a flow guide part that is formed in the cooling channel and guides the cooling fluid, which flows in the cooling channel through the intake port when the piston moves up or down, to flow to the exhaust port through the cooling channel.

3 Claims, 7 Drawing Sheets

PRIOR ART

PRIOR ART

PISTON COOLING APPARATUS

CROSS-REFERENCE TO RELATED APPLICATIONS

This application is a Section 371 National Stage Application of International Application No. PCT/KR2009/006070, filed Oct. 21, 2009 and published as WO2010/047518 on Apr. 29, 2010 not in English.

FIELD OF THE DISCLOSURE

The present invention relates to a piston cooling device for cooling a piston reciprocating in a cylinder of an internal combustion engine, such as an engine, and more particularly, to a piston cooling device that cools a piston by circulating cooling fluid in the piston.

BACKGROUND OF THE DISCLOSURE

In general, the engines used for vehicles or construction equipment include a cylinder and a piston that reciprocates inside the cylinder. The piston, a part for transmitting explosive pressure inside the cylinder to a crankshaft through a connecting rod, is exposed to high-temperature combustion gas as well as high combustion pressure, such that it may be easily damaged, such as fatigue failure or frictional wear due to thermal deformation, and fusion. For this reason, the piston has a specific cooling structure and an example of the structure is shown in FIG. 1.

Referring to FIG. 1, an oil gallery 2 is formed in a ring shape in a piston 1. Further, an oil intake port 3 is formed at a side of oil gallery 2, an oil exhaust port 4 is formed at the other side of oil gallery 2, and an oil jet 5 is disposed adjacent to oil intake port 3.

Cooling oil injected by the oil jet 5 flows into the oil gallery 2 through the oil intake port 3, circulates through the oil gallery 2, and is then discharged through the oil exhaust port 4. The cooling oil that flows as described above cools piston 1 by taking heat from the piston 1.

However, as shown in FIGS. 2 and 3, most of the oil injected from the oil jet 5 fails to flow into the oil gallery 2 through the oil intake port 3 and is discharged to the oil intake port 3 while hitting against the upper inner side of the oil gallery 2. Accordingly, only a small amount of the oil injected from the oil jet 5 flows into the oil gallery 2.

As described above, since the amount of the oil flowing into the oil gallery 2 is small, the amount of the oil circulating in oil gallery 2 decreases, such that the cooling efficiency of the piston 1 decreases. Further, the small amount of the oil flowing in the oil gallery 2 remains in the oil gallery 2 for a long time because it is difficult to move to the oil exhaust port 4, and the temperature of the oil in the oil gallery 2 correspondingly increases, such that the cooling efficiency of the piston 1 further decreases.

Meanwhile, the portion connected with the oil intake port 3 of oil gallery 2 is in contact with the low-temperature oil injected by the oil jet 5, such that the portion is more cooled than the other portions. For this reason, a temperature difference occurs in the piston 1 and thermal stress is exerted in the piston 1 due to the temperature difference, such that the durability decreases.

As described above, since not only the cooling efficiency of the piston with the oil gallery of the related art is low, but the thermal stress due to a temperature difference is exerted, resulting in the piston and other parts around the piston to be easily damaged.

The discussion above is merely provided for general background information and is not intended to be used as an aid in determining the scope of the claimed subject matter.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The disclosed embodiments have been made in an effort to provide a piston cooling device that can improve cooing efficiency of a piston.

Further, the disclosed embodiments have been made in an effort to provide a piston cooling device that can reduce damage to a piston and other parts around the piston due to thermal stress, by reducing a temperature difference in the piston.

An exemplary embodiment of the present invention provides a piston cooling device including: a cooling channel 20 that is formed in a piston 10 such that cooling fluid flows, and communicates with an intake port 21 through which the cooling fluid flows inside from the outside at a point and with an exhaust port 22 through which the cooling fluid is discharged outside at another point; and a flow guide part 30 that is formed in the cooling channel 20 and guides the cooling fluid, which flows in the cooling channel 20 through the intake port 21 when the piston 10 moves up or down, to flow to the exhaust port 22 through the cooling channel 20.

The flow guide part 30 may includes: an upward guide 31 that is formed at the lower portion in the cooling channel 20 such that the cooling fluid flowing in the cooling channel 20 when the piston 10 moves up flows to the exhaust port 22 through the cooling channel 20; and a downward guide 33 that is formed at the upper portion in the cooling channel 20 such that the cooling fluid flowing in the cooling channel 20 when the piston 10 moves down flows to the exhaust port 22 through the cooling channel 20.

The upward guide 31 may includes a plurality of upward protrusions 32 on the bottom of the cooling channel 20, the downward guide 33 includes a plurality of downward protrusions 34 on the top of the cooling channel 20, and the upward protrusions 32 and the downward protrusions 34 are alternately disposed along the cooling channel 20.

Further, the upward protrusions 32 and the downward protrusions 34 may include curved surfaces 32*b* and 34*b*, respectively.

The piston cooling device may further includes an intake guide part 40 that is formed at a position of the cooling channel 20 which is connected with the intake port 21, and guides the cooling fluid flowing inside through the intake port 21 into the cooling channel 20.

Another exemplary embodiment of the present invention provides a piston cooling device including: a cooling channel 20 that is formed in a piston 10 such that cooling fluid flows, and communicates with an intake port 21 through which the cooling fluid flows inside from the outside at a point and with an exhaust port 22 through which the cooling fluid is discharged to the outside at another point; and an intake guide part 40 that is formed at a point where the intake port 21 and the cooling channel 20 are connected, and guides the cooling fluid flowing inside through the intake port 21 into the cooling channel 20.

According to exemplary embodiments of the present invention, it is possible to increase the amount of the oil circulating in the cooling channel, and thus it is possible to improve the cooling efficiency of the piston, by forming the flow guide part in the cooling channel such that the cooling fluid can flow through the cooling channel, when the piston moves up or down.

In particular, it is possible to further increase the flow rate of the cooling fluid in the cooling channel and further improve the cooling efficiency of the piston, by forming the upward guide that allows the cooling fluid to flow with the upward motion of the piston and the downward guide that allows the cooling fluid to flow with the downward motion of the piston.

Further, since the upward guide has a plurality of upward protrusions and the downward guide has a plurality of downward protrusions, and the upward guide and the downward guide are alternately disposed, it is possible to further increase the flow rate of the cooling fluid in the cooling channel, such that it is possible to further improve the cooling efficiency.

Furthermore, it is possible to minimize the amount of cooling fluid reflected from the cooling channel and discharged to the outside through the intake port, by allowing the cooling fluid, which flows inside through the intake port, to flows into the cooling channel, by forming an intake guide part at a point of the cooling channel which is connected with the intake port. In other words, it is possible to increase the flow rate of cooling fluid flowing into the cooling channel through the intake port. Therefore, it is possible to not only maximize the cooling efficiency of the piston, but minimize thermal stress by reducing a temperature difference in the piston.

In addition, it is possible to minimize separation of the cooling fluid from the inner circumferential surface of the cooling channel, and accordingly, it is possible to further improve the cooling efficiency, by curving the flow guide part and the intake guide part.

DETAILED DESCRIPTION

Hereinafter, a piston cooling device according to an exemplary embodiment of the present invention is described in detail.

Figure 1:
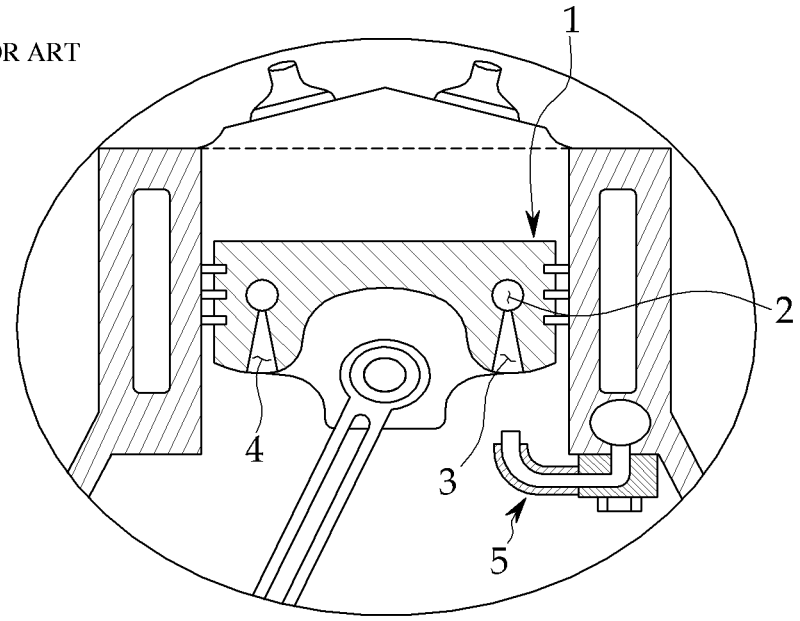
Figure 1 PRIOR ART
FIG. 1 is a cross-sectional view schematically showing a common piston cooling structure.
Figure 2:
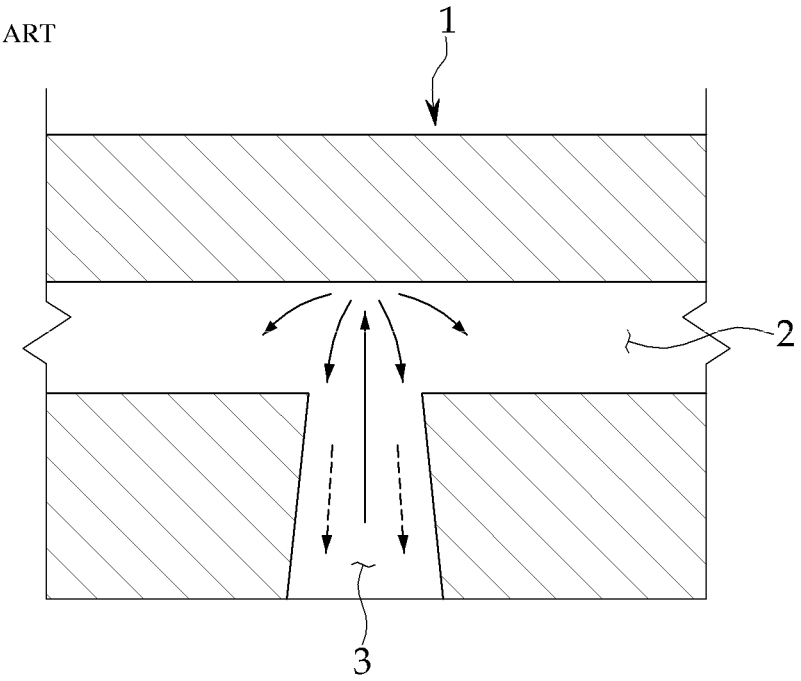
FIG. 2 is a conceptual view schematically showing a cross-section of an intake port and an oil gallery of the piston cooling structure of FIG. 1.
Figure 3:
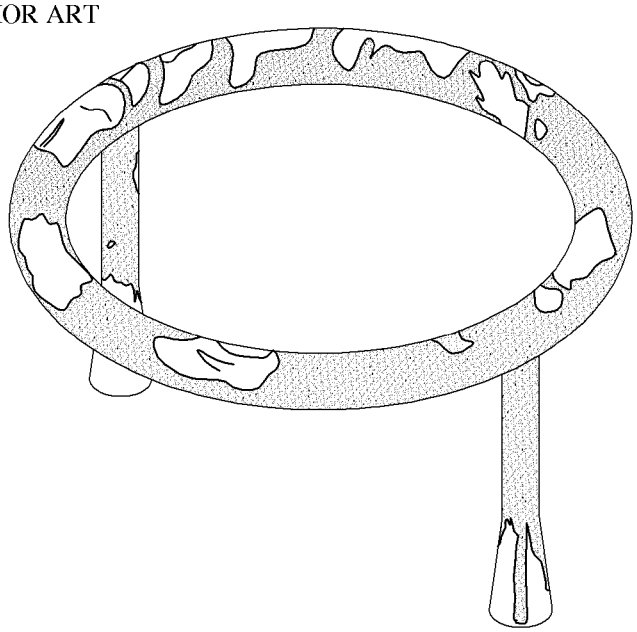
FIG. 3 is a view schematically showing a result of simulating oil flow status in the oil gallery shown in FIG. 2.
Figure 4:
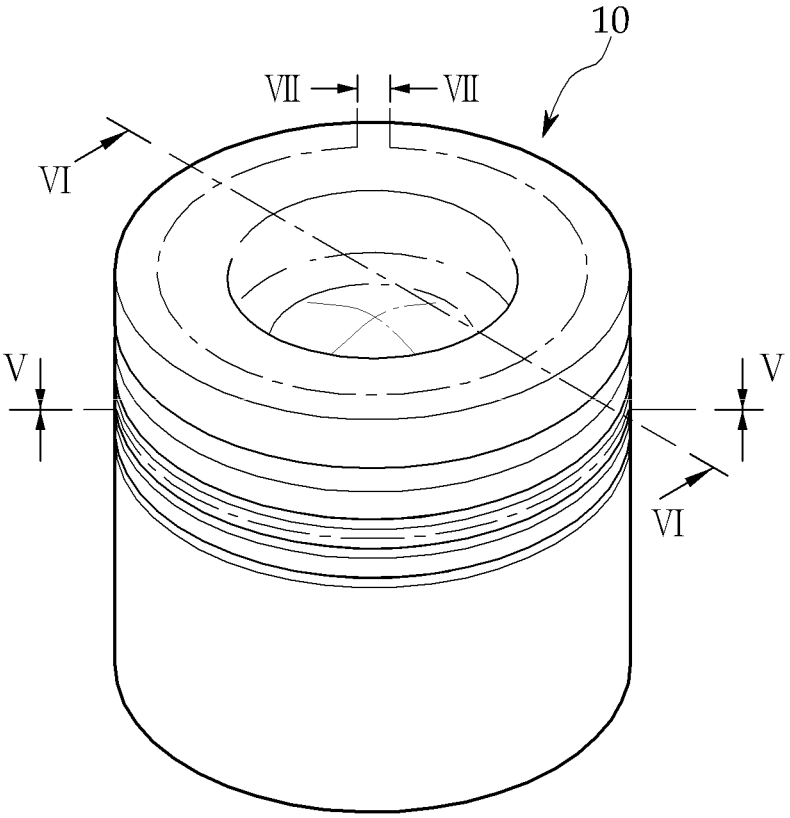
FIG. 4 is a perspective view schematically showing a piston equipped with a piston cooling device according to an exemplary embodiment of the present invention.
Figure 5:
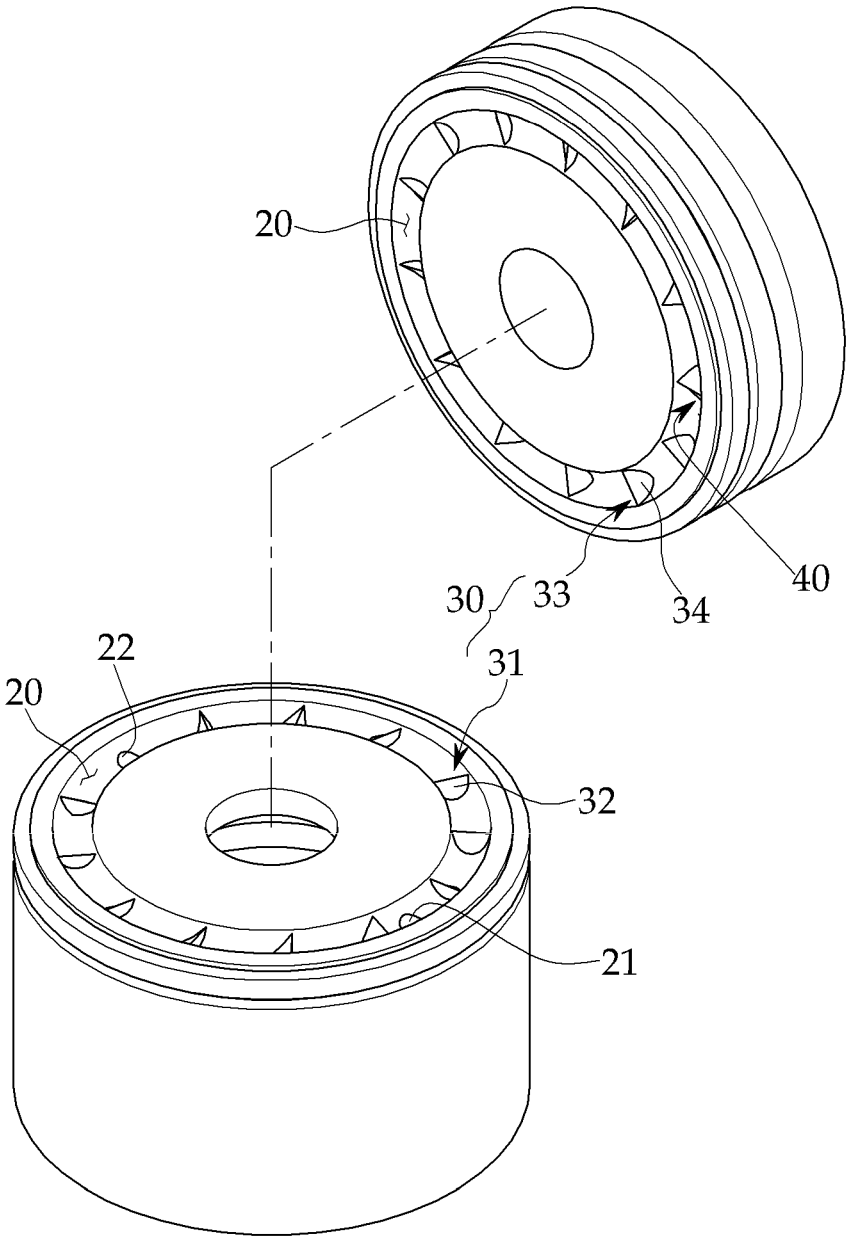
FIG. 5 is a perspective view showing the piston of FIG. 4 taken along the line V-V to schematically show the main part of the piston cooling device according to the exemplary embodiment of the present invention.
Figure 6:
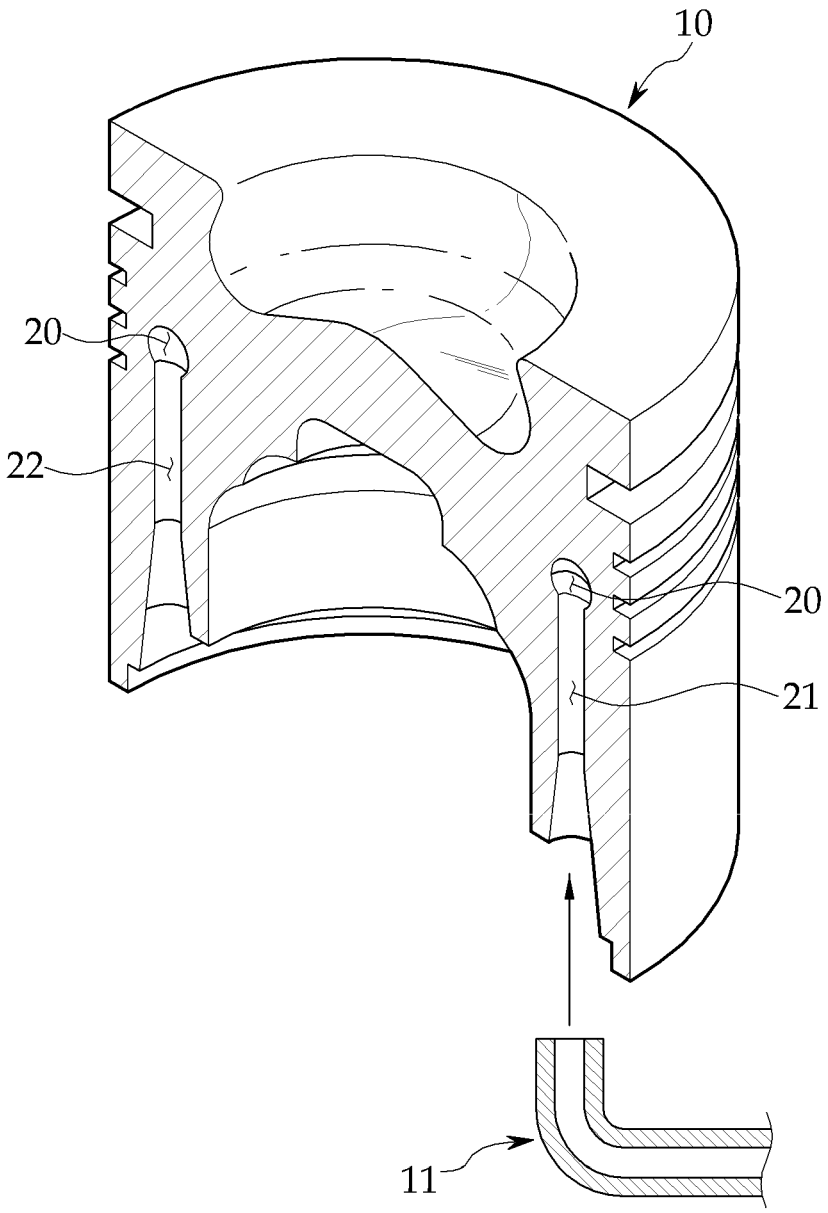
FIG. 6 is a cross-sectional perspective view of the piston of FIG. 4 taken along the line VI-VI.

A piston cooling device according to an exemplary embodiment of the present invention is provided to cool a piston 10 shown in FIG. 4 and implemented in the form of a channel through which cooling fluid can flow in the piston 10.

The piston cooling device, as shown in FIGS. 5 to 10, includes a cooling channel 20 that has an intake port 21 and an exhaust port 22 and through which cooling fluid, such as oil, flows, a flow guide part 30 that is disposed in the cooling channel 20 and guides the flow of the cooling fluid, and an intake guide unit 40 that guides the cooling fluid, which flows inside through the intake port 21, into the cooling channel 20.

The cooling channel 20 is a space through which the cooling fluid that cools the piston 10 flows and is formed in a ring shape in the piston 10. However, the shape of the cooling channel 20 may be changed in various ways, different from the exemplary embodiment. The cooling channel 20 communicates with the intake port 21 at one point and with the exhaust port 22 at another point.

The intake port 21 is provided to make the cooling fluid flow into the cooling channel 20 by using an injector, such as an oil jet 11 and may have a shape of which the area gradually increases from the upper portion to the lower portion. This is because the cooling fluid flows inside through the intake port 21. The oil jet 11 is provided to inject the cooling fluid that is compressed by an oil pump (not shown) into the intake port 21 and communicates with an oil channel formed in a cylinder block.

Exhaust port 22 is a channel through which the oil that increases in temperature through the cooling channel 20 is discharged and may be disposed at 180° from the intake port 21. This is for allowing the cooling fluid that flows inside through the lower portion of the intake port 21 and flows along the cooling channel 20 to uniformly cool the piston 10.

Hereinafter, a process of flowing of the cooling fluid through the cooling channel 20 having the structure described above is described. First, the cooling fluid injected from the oil jet 11 flows into the cooling channel 20 through the intake port 21. The cooling fluid flowing in the cooling channel 20 cools the piston 10 while flowing to the two-way exhaust port 22. Thereafter, the cooling fluid is discharged outside the piston 10 through the exhaust port 22 and the discharged oil returns to an oil pan through the cylinder block.

In this process, the larger the flow rate of the cooling water flowing through the cooling channel 20, the more the cooling efficiency of the piston 10 is improved. Therefore, it is required to increase the amount of cooling fluid flowing into the cooling channel 20 through the intake port 21 and the amount and velocity of the cooling fluid flowing through the cooling channel 20, in order to improve the cooling efficiency of the piston 10. In the exemplary embodiment, flow the guide part 30 is provided to increase the flow rate of the cooling fluid flowing through the cooling channel 20 and the intake guide unit 40 is provided to increase the flow rate of the cooling fluid flowing into the cooling channel 20. Hereinafter, the flow guide part 30 and the intake guide unit 40 are described in detail.

The flow guide part 30 is provided to allow the cooling fluid to flow to the exhaust port 22, with the piston 10 moves up/down, and includes an upward guide 31 and a downward guide 33.

The upward guide 31 is provided to allow the cooling fluid to flow to the exhaust port 22 by using the inertial force of the cooling fluid, when the piston 10 moves up, and disposed at the lower portion of the cooling channel 20. Since the upward motion of the piston 10 is an acceleration motion, the cooling fluid flowing in the cooling channel 20 flows to the lower portion of the cooling channel 20 by the inertial force. In detail, the cooling fluid moves downward with respect to the piston 10, when the piston 10 moves up. The cooling fluid moving down is guided to the exhaust port 22 by the upward guide 31.

The upward guide 31 has a plurality of upward protrusions 32 that protrudes upward from the bottom of the cooling channel 20. The upward protrusion 32 is composed of an upward vertical wall 32*a* that is formed vertically upward from the bottom of the cooling channel 20 and an upward curved surface 32*b* that is curved downward from a vertical wall 32*a*, at the side close to the exhaust port 22 in the vertical wall 32*a*. This is for minimizing the reflection of the cooling fluid from the upward curved surface 32*b* and separation from the upward curved surface 32*b* and allowing the cooling fluid to naturally flow along the upward curved surface 32*b*, when the cooling fluid moves down and hits against the upward curved surface 32*b* by the upward motion of the piston 10. Therefore, the amount of time that the cooling fluid is in contact with the cooling channel 20 can be maximize, such that it is possible to further increase the cooling efficiency.

The downward guide 33 is provided to allow the cooling fluid to flow to the exhaust port 22 by using the inertial force of the cooling fluid, when the piston 10 moves down, and disposed at the upper portion of the cooling channel 20. Since the downward motion of the piston 10 is an acceleration motion, the cooling fluid flowing in the cooling channel 20 flows to the upper portion of the cooling channel 20 by the inertial force, when the piston 10 moves down. In detail, when the piston 10 moves down, the cooling fluid moved upward with respect to the piston 10 and the cooling fluid moving upward is guided to the exhaust port 22 by the downward guide 33.

The downward guide 33 has a plurality of downward protrusions 34 that protrudes downward from the top of the cooling channel 20. The downward protrusion 34 is composed of a downward vertical wall 34*a* that is formed vertically downward from the bottom of the cooling channel 20 and a downward curved surface 34*b* that is curved upward from the vertical wall 34*a*, at the side close to the exhaust port 22 in the downward vertical wall 34*a*. This is for minimizing the reflection of the cooling fluid from the downward curved surface 34*b* and separation from the downward curved surface 34*b* and allowing the cooling fluid to naturally flow along the downward curved surface 34*b*, when the cooling fluid moves up and hits against the downward curved surface 34*b* by the downward motion of the piston 10. Therefore, the time that the cooling fluid is in contact with the cooling channel 20 can be maximized, such that it is possible to more improve the cooling efficiency.

Meanwhile, the upward protrusions 32 and the downward protrusions 34 are alternately disposed along the cooling channel 20. Therefore, the cooling fluid moves to the exhaust port 22 by the downward protrusions 34 when the piston 10 moves down, and the cooling fluid that has moved to the exhaust port 22 by the downward protrusions 34 when the piston 10 moves up moves again to the exhaust port 22 by the upward protrusions 32 that are close to the downward protrusion 34 toward the exhaust port 22. Thereafter, as the piston 10 moves down, the cooling fluid is moved again to the exhaust port 22 by the downward protrusions 34 that are close to the upward protrusions 32 toward the exhaust port 22. Those processes are repeated and the cooling fluid flowing in the cooling channel 20 rapidly moves to the exhaust port 22.

As described above, it is possible to increase the flow rate in the cooling channel 20 and remarkably improve the cooling efficiency of the piston 10, by allowing the cooling fluid, which moves only up and down in the cooling channel 20 even if the piston 10 moves up/down in the related art, to flow through the cooling channel 20 in accordance with the up-down motion of the piston 10.

Although it is exemplified in the exemplary embodiment that the upward guide 31 and the downward guide 33 are each composed of a plurality of protrusions 32 and 34, it is possible to increase the flow rate of the cooling fluid in comparison to the related art, even if the upward guide 31 and the downward guide 33 are each composed of a single protrusion, unlike the exemplary embodiment. Therefore, the configuration in which the upward guide 31 or the downward guide 33 is composed of a single protrusions is included in the spirit of the present invention.

Further, it is exemplified in the exemplary embodiment that the curved surfaces 32*b* and 34*b* are formed at the sides of the vertical walls 32*a* and 34*a*, different from the exemplary embodiment, the curved surfaces 32*b* and 34*b* may be inclined surfaces that are inclined to the exhaust port 22 and this case should also be construed as using the spirit of the present invention.

Furthermore, although it is exemplified in the exemplary embodiment that the flow guide part 30 includes the upward guide 31 and the downward guide 33, the flow guide part 30 may include only any one of the upward guide 31 and the downward guide 33.

The intake guide part 40, as described above, is provided to guide the cooling fluid flowing inside through the intake port 21 into the cooling channel 20 and is formed at a position of the cooling channel 20 where the intake port 21 is connected. As described above, most of the cooling fluid flowing inside through the intake port 21 in the related art is discharged back to the intake port 21 after hitting against the inner top of the cooling channel 20. Therefore, the flow rate of the cooling fluid flowing into the cooling channel 20 is insufficient, such that cooling efficiency of the piston 10 is considerably reduced. Accordingly, the flow guide part 40 is provided to guide the cooling fluid flowing inside through the intake port 21 into the cooling channel 20, in the exemplary embodiment.

The intake guide part 40 is implemented by an intake protrusion 40 that protrudes downward from the top of the cooling channel 20, and the intake protrusion 40 has a first intake curved surface 40*a* curved in a predetermined direction in the cooling channel 20 and a second intake curved surface 40*b* curved in the opposite direction in the cooling channel 20. According to this configuration, the cooling fluid flowing inside through the intake port 21 is guided by the first intake curved surface 40*a* to flow in a predetermined direction through the cooling channel 20 and is also guided by the second intake curved surface 40*b* to flow in the opposite direction through the cooling channel 20.

Although the two intake curved surfaces 40*a* and 40*b* are used because the cooling channel 20 is formed in a ring shape and the exhaust port 22 and the intake port 21 are positioned at 180 degrees from each other, the intake curved surfaces 40*a* and 40*b* may be implemented by one curved surface that is curved to the exhaust port 22, when the cooling channel connecting the intake port 21 with the exhaust port 22 is designed in one path, unlike the exemplary embodiment. Further, although it is exemplified that the intake guide part 40 has the curved surfaces 40*a* and 40*b* in the exemplary embodiment, unlike the exemplary embodiment, the intake guide part 40 may be changed into various shapes, such as a curved surface, as long as it can guide the cooling fluid flowing in the intake port 21 into the cooling channel 20.

The operation of the piston cooling device having the configuration described above is described hereafter.

Figure 7:
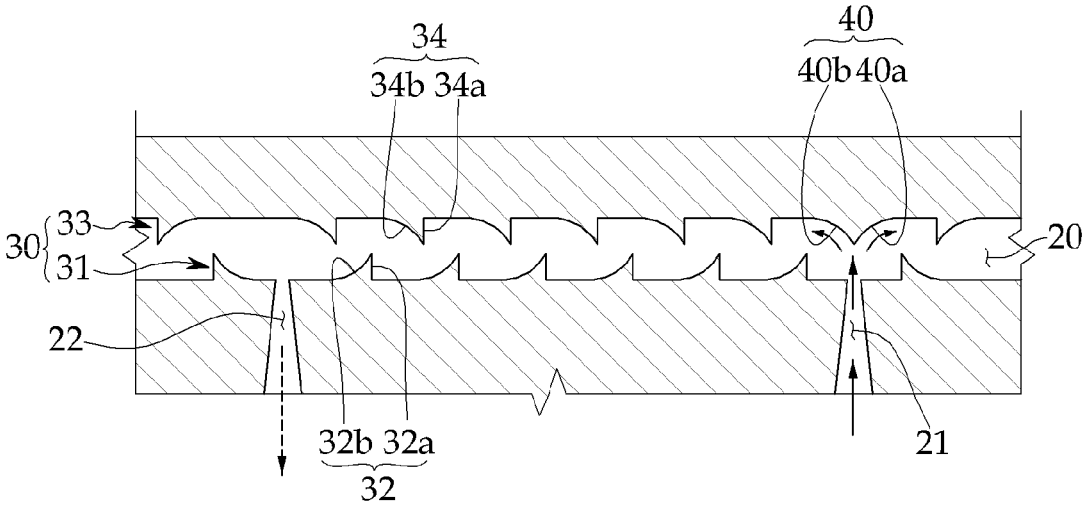
FIGS. 7 to 9 are conceptual developed views of the piston of FIG. 4 partially taken along the line VII-VII to illustrate the flow direction of cooling fluid.

First, as shown in FIG. 7, the cooling fluid injected from the oil jet 11 flows into the cooling channel 20 through the intake port 21. The fluid flowing in the cooling channel 20 is guided to the right side in the figure by the first intake curved surface 40*a* and flows to the right side in the cooling channel 20, and is then guided to the left side by the second intake curved surface 40*b* and flows to the left side in the cooling channel 20. As described above, as the cooling fluid is guided into the cooling channel 20 by the first and second intake curved surfaces 40*a* and 40*b*, the amount of the cooling fluid discharged back to the intake port 21 can be minimized. That is, the flow rate of the cooling fluid flowing into the cooling channel 20 through the intake port 21 increases, such that the cooling efficiency of the piston 10 can be significantly improved. Further, although the point where the intake port and the oil gallery meet is overcooled and the temperature is very low and the other point of the cooling channel is undercooled and the temperature increases, that is, a temperature difference occurs in the related art, the exemplary embodiment makes it possible to minimize the temperature difference by allowing most of the cooling fluid flowing through the intake port 21 to flow into the cooling channel 20.

Figure 8:
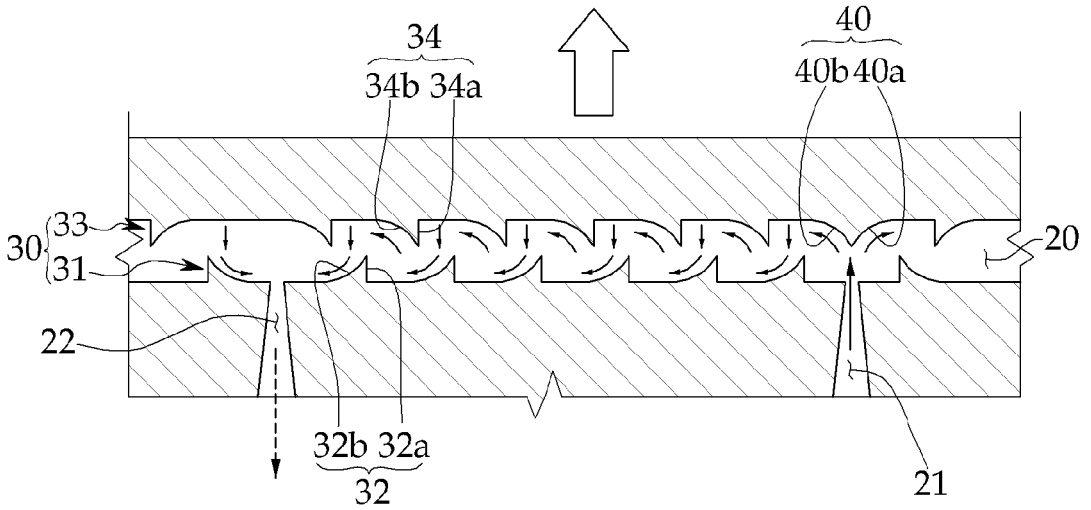

FIG. 8 schematically shows the flow direction of the cooling fluid when the piston 10 moves up, in which the cooling fluid flowing in the cooling channel 20 moves down by the upward motion of the piston 10 and the cooling fluid moving down is guided by the upward curved surface 32*b* to flow to the exhaust port 22.

Figure 9:
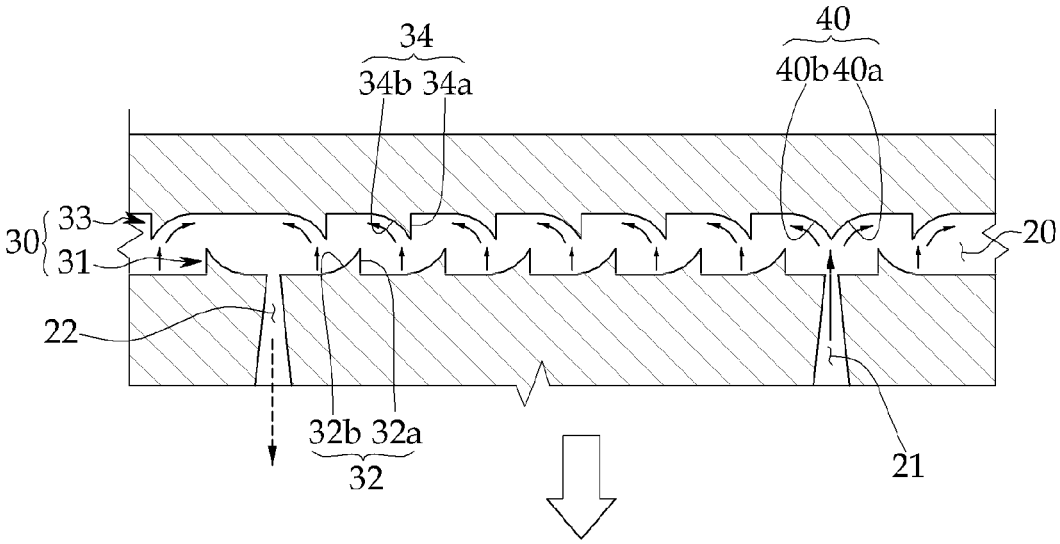
Figure 10:
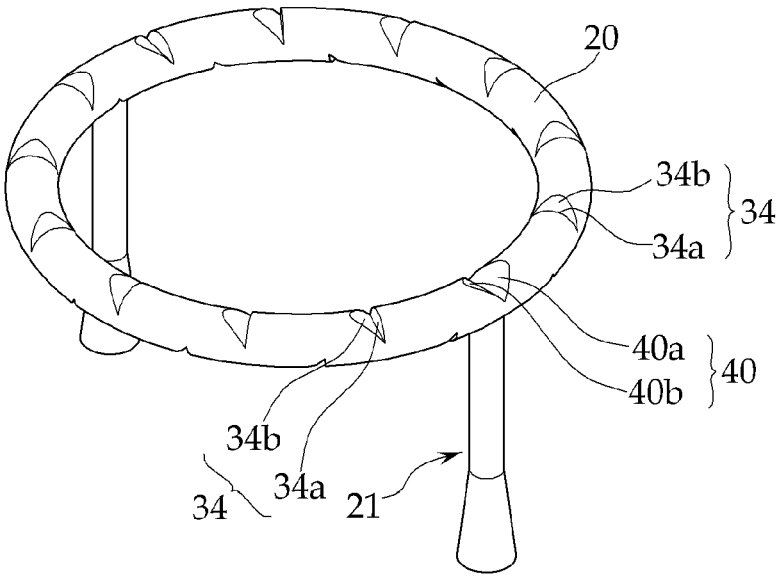
FIG. 10 is a conceptual view schematically making the cooling device shown in FIG. 4.

FIG. 9 schematically shows the flow direction of the cooling fluid when the piston 10 moves down, in which the cooling fluid flowing in the cooling channel 20 moves up by the downward motion of the piston 10 and the cooling fluid moving up is guided by the downward curved surface 34*b* to flow to the exhaust port 22.

As described above, it is possible to increase the flow rate of the cooling fluid in the cooling channel 20, and thus it is possible to further improve the cooling efficiency of the piston 10, by allowing the cooling fluid flowing in the cooling channel 20 to flow to the exhaust port 22 with the up-down reciprocation of the piston 10.

The present invention can be applied to internal combustion engines, such as a diesel engine or a gasoline engine.

Although the present invention has been described with reference to preferred embodiments, workers skilled in the art will recognize that changes may be made in form and detail without departing from the spirit and scope of the invention.

The invention claimed is:

1. A piston cooling device of an engine for use with a vehicle or construction equipment, comprising:

a cooling channel that is formed within a piston, and communicates at a point with an intake port through which cooling fluid flows inside from the outside thereof and at another point with an exhaust port through which the cooling fluid is discharged outside; and a flow guide part that is formed in the cooling channel and guides the cooling fluid, which flows in the cooling channel through the intake port when the piston moves up, to flow to the exhaust port through the cooling channel, wherein the flow guide part comprises:

an upward guide that has a curved surface guiding the cooling fluid flowing down in the cooling channel by inertial force when the piston moves up to flow to the exhaust port, and is formed at a lower portion of the cooling channel; and a downward guide that has a curved surface guiding the cooling fluid flowing up in the cooling channel by inertial force when the piston moves down to flow to the exhaust port, and is formed at a upper portion of the cooling channel, wherein the upward guide and downward guide have flat surfaces parallel with the axis of piston reciprocation and face away from the curved surfaces, wherein the upward guide includes a plurality of upward protrusions at a bottom portion of the cooling channel, the downward guide includes a plurality of downward protrusions at a top portion of the cooling channel, and the upward protrusions and the downward protrusions are alternately disposed along the cooling channel, wherein the upward protrusions of the upward guide comprises:

an upward vertical wall that is formed vertically upward from the bottom of the cooling channel; and an upward curved surface that is curved downward from the upward vertical wall and is formed at the side close to the exhaust port in the upward vertical wall, wherein the downward protrusions of the downward guide comprises:

a downward vertical wall that is formed vertically downward from the bottom of the cooling channel; and a downward curved surface that is curved upward from the downward vertical wall and is formed at the side close to the exhaust port in the downward vertical wall.

2. The piston cooling device of claim 1, further comprising an intake guide part that is formed at a position of the cooling channel which is connected with the intake port, and guides the cooling fluid flowing inside through the intake port to flow into the cooling channel.

3. The piston cooling device of claim 2, wherein the intake guide part comprises an intake protrusion including a first intake curved surface curved in a predetermined direction in the cooling channel and a second intake curved surface curved in the opposite direction in the cooling channel.

* * * * *